US006259590B1

(12) United States Patent
Daoud et al.

(10) Patent No.: US 6,259,590 B1
(45) Date of Patent: Jul. 10, 2001

(54) GROUNDING DEVICE FOR PREVENTING LORENTZ FORCE IN VOLTAGE SURGE PROTECTION

(75) Inventors: Bassel Hage Daoud, Parsippany; Walter Pelosi, Randolph; Mikhail Sumetskiy, Bridgewater, all of NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/338,344

(22) Filed: Jun. 22, 1999

(51) Int. Cl.[7] ..... H01C 7/12
(52) U.S. Cl. ..... 361/119; 361/118
(58) Field of Search ..... 361/54, 56, 117, 361/118, 119, 124, 103, 104, 111; 379/412, 399

(56) References Cited

U.S. PATENT DOCUMENTS 4,733,325 * 3/1988 Loesch ..... 361/19
4,796,150 * 1/1989 Dickey et al. ..... 361/119
4,876,621 * 10/1989 Rust et al. ..... 361/58
4,958,254 * 9/1990 Kidd et al. ..... 361/119
5,587,861 * 12/1996 Wieloch et al. ..... 361/14

* cited by examiner

*Primary Examiner*—Michael J. Sherry
*Assistant Examiner*—Kim Huynh

(57) ABSTRACT

A grounding device connected to telecommunications equipment for providing protection against high voltage surges. The grounding device includes an electronic module clip having first and second legs and defining first and second current carrying branches. A discharge member is provided in contact with the clip for providing a discharge path to common ground for current carried by the clip as a result of a high voltage surge. The discharge member and clip are interfaced in a manner to reduce the magnetic force generated in the second leg by a voltage surge and preventing the deformation and separation of the discharge member from the clip.

6 Claims, 2 Drawing Sheets

GROUNDING DEVICE FOR PREVENTING LORENTZ FORCE IN VOLTAGE SURGE PROTECTION

BACKGROUND OF THE INVENTION

1. Field of the Invention

The present invention pertains to protection devices for use with telecommunications equipment, and particularly to devices for protecting telecommunications equipment from potentially damaging current and voltage surges.

2. Description of the Related Art

Grounding mechanisms or devices are designed to protect telecommunications equipment from current surges and voltage surges by providing a grounding path in the event that either such event occurs. Grounding is necessary to prevent current and voltage surges from reaching and damaging fragile telecommunications equipment. Voltage surges typically result from lightning strikes which can generate voltages on the order of 20,000 volts.

A known solid state grounding device or protector 10 is depicted in FIGS. 1 and 2. The grounding protector 10 serves as an interface between an electronic module 12 having one or more diodes for connecting a tip wire 14 and a ring wire 16 to ground to allow the discharge of damaging voltage and current surges. The device 10 includes a pair of current sensors in the form of heat coils 18, 20, one for each of the tip and ring wires, respectively. The coils are mounted to a mounting base 32 and are biased in the downward direction relative to or toward the mounting base by tip spring 22 and ring spring 24. The heat coils 18 and 20 are maintained in an "up" or vertically offset position from the mounting base 32 by hardened solder lands or formations 30.

A leaf spring 26 is partially contained within a sleeve 28 that is mounted to module 12. The leaf spring is horizontally off-set or displaced from the tip and ring heat coils 18, 20 and is in physical and electrical contact with a module or diode clip 29 for providing a grounding path from the module 12 through the base 32 for voltage surges. Particularly, the leaf spring 26 contacts the diode clip 29 at a node 46 contained within a conducting region 38 (depicted in dashed lines in FIG. 2 and shown in detail in FIG. 3) and is supported, in part, by a grounding device housing 36.

In operation, and in the event of a current surge of relatively long duration through, for example, the tip wire 14, the solder land 30 on tip heat coil 18 will melt, allowing heat coil 18 to be displaced downward under the urgency of spring 22 into abutment with base 32 and thereby connect to a common ground through base 32. Since the module 12 is connected to both the tip and ring heating coils 18, 20, the assembly will tilt slightly in a direction of the movement of the heat coil.

In the event of a voltage surge such as from a lightning strike, the arc resulting therefrom will extend from the diode clip 29 to the leaf spring 26 through node 46 and be discharged to common ground through base 32. A problem that occurs, however, is that the arc will generate a force that pushes against the leaf spring 26, in the direction shown by arrow 34, thereby deflecting and permanently bending the leaf spring 26 away from diode clip 29, i.e. out of physical and possible electrical contact with module 12. This result renders the prior art grounding mechanism unable to defend against any subsequently occurring voltage and/or current surges, leaving the delicate telecommunications equipment connected through module 12 particularly susceptible to damage from such subsequently occurring surges.

SUMMARY OF THE INVENTION

The present invention provides an improved grounding device for protecting telecommunications equipment from damaging voltage spikes that occur, for example, as a result of lightning strikes. The grounding device includes a mounting base to which the tip and ring wires of a communications line are connected. The mounting base provides a grounding path for allowing the discharge to ground of voltage spikes without causing damage to telecommunications equipment connected to the tip and ring wires. A pair of heat coils, one for each of the tip and ring wires, are provided. The heat coils are positionally biased in the direction of the mounting base by coil springs that operatively displace the heat coils to a grounding position against the mounting base in the event that a current surge of a relatively long duration is detected. An electronic module current carrying member is provided having a first leg for defining a first current path for carrying relatively short duration current generated from a large surge in a first direction along the grounding path. The current carrying member also includes a second leg which defines a second current path for carrying the short duration current in a second direction. A voltage discharge member for discharging the relatively short duration current through the grounding path is positioned in contact with the current carrying member between the first and second legs at a location closer to the second leg so that the second current path is shorter than the first current path. The positioning of the voltage discharge member in this manner reduces the opposing electromagnetic force applied from the current carrying member against the voltage discharge member and prevents the voltage discharge member from becoming deformed and, thereby, spaced or detached from the current carrying member by a high surge.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 3:
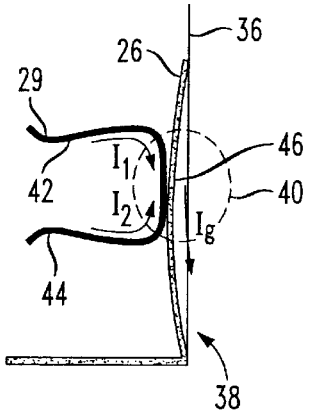
FIG. 3 PRIOR ART
FIG. 3 is a left side close-up view of a portion of the prior art grounding device depicted in FIG. 1.
Figure 4:
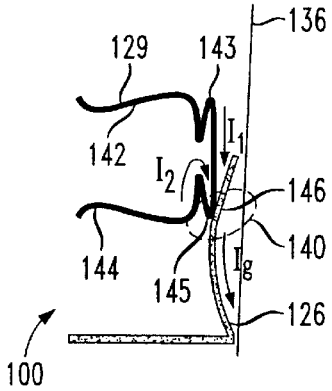
FIG. 4 is a left-side close-up view of a portion of a grounding device in accordance with the present invention.

FIG. 4 depicts the relevant portion of a grounding device 100 in accordance with the invention, namely the contact region between a current carrying member 129, in the form of an electronic module clip, and a voltage surge discharge member 126. Like the prior art device 10 of FIGS. 1–3, discussed above, module clip 129 is connected to an electronic module 12 for providing an interface with the voltage surge discharge member 126. The interface yields a grounding path through discharge member 126 and through a ground terminal in the grounding device base (i.e. base 32). The module clip is configured as a substantially "U" or "C" shaped member having a first leg 142 defining a first bent region 143 and a second leg 144 defining a second bent region 145.

As in the prior art device, discharge member 126 is implemented as a leaf spring constructed of electrically conductive material and is mountedly positioned at one end against a device housing wall 136, with the other end connected to ground through the device base. For reasons explained more fully below, the leaf spring 126 contacts current carrying member or clip 129 in a region designated by the dashed lines as 140 and, specifically, at a contact point or node 146.

With continued reference to FIG. 3, when a high surge occurs, such as from a lighting strike applied directly or indirectly to module 12 and module clip 29, a high current of relatively short duration that is instantaneously produced must be directed to common electric ground through the grounding path, i.e. through leaf spring 26 and base 32, so as to avoid damage to telecommunication equipment connected to the module clip 29. As shown in FIG.3, the clip 29 is substantially "U" or "C" shaped and has a first leg 42 and a second leg 44 and contacts the leaf spring 26 within a conducting region 38 at a contact node 46. The contact node 46 defines two current paths, the first through leg 42, across node 46, and through leaf spring 26 to ground, and the second path through leg 44, across node 46 and through leaf spring 26 to ground.

When the high current is produced from a surge, the current can travel along both the first and second current paths through clip 29. This is shown in FIG. 3 as current $I_1$, traveling in a clockwise direction along leg 42 and in the direction of the grounding path through spring 26, and as current $I_2$ traveling in the opposite or counterclockwise direction relative to current $I_1$. The resulting grounding current is designated as $I_g$ and is shown traveling along leaf spring 26 in a direction toward base 32 to ground.

Figure 1:
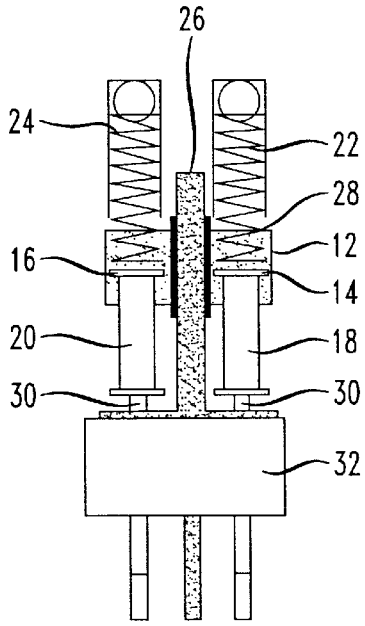
FIG. 1 PRIOR ART
FIG. 1 is a front face view of a prior art grounding device.
Figure 2:
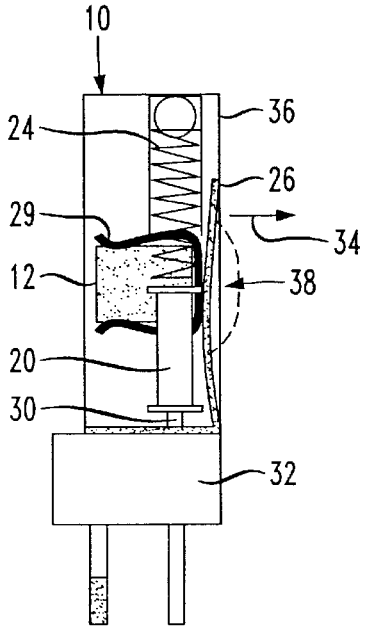
FIG. 2 PRIOR ART
FIG. 2 is a left-side view of the prior art device of FIG. 1.

As is known in the art, there is a problem that arises when a surge is applied to known grounding protectors of the type depicted in FIGS. 1–3—specifically, deformation and the resulting separation and removal of contact between clip 29 and spring 26 which occurs as a result of a large repulsive Lorentz force or "explosion" that is produced in the direction of arrow 34 in FIG. 1. Applicants have discovered that the detrimental explosion force is primarily the result of opposing magnetic fields that are generated between clip 29 and spring 26. In particular, it has been discovered that the oppositely traveling current $I_2$ along the second leg 44 of clip 29 produces a repelling magnetic field relative to the magnetic field produced by current $I_g$ in spring 26, and that this is due to the overlap area of second leg 44 with leaf spring 26 as shown in region 40.

Utilizing this discovery of the source for the explosion force resulting from a high voltage surge applied to known grounding protector devices, applicants have invented a new grounding device, the relevant (i.e. modified) portion of which is depicted in FIG. 4. As shown, and as described in connection with the prior art device 10 of FIG. 3 above, the device 100 of FIG. 4 also contains a clip 142 having first and second legs 142, 144 which define respective first and second current carrying paths between the first and second legs, node 146 and leaf spring 126, respectively. However, in this modified implementation the position of node 146 has been displaced from the location shown in FIG. 3 to that shown in FIG. 4 and the clip 129 has been modified to include bent regions 143 and 145 which function to reorient current $I_2$ at node 146 to be in the same direction as current $I_1$. As a result, there is a significant reduction in the opposing magnetic field generated by current $I_2$ through leg 144 and in the force applied against leaf spring 126, thereby safeguarding against deformation and detachment of clip 129 from spring 126.

As should now be apparent, in order for the device 100 to work in the intended manner contact node 146 need only be positioned relative to spring clip 129 so that the direction of current $I_2$ is the sane as current $I_1$, at node 146. In FIG. 4, this also results in node 146 being positioned closer to second leg 144 than to first leg 142 so that the second current carrying path is shorter than the first current carrying path. Thus, it will be apparent that clip 129 can be designed as the same shape as clip 29 (i.e. without bent regions 143, 145) so long as the contact node 146 is positioned to direct current $I_2$ in the same direction as $I_1$. Since the diode clip 129 is typically constructed from a stronger and less malleable material (e.g. steel) than the spring material (e.g. copper) the forces generated in the bent regions 143, 145 as a result of oppositely-flowing current do not deform the clip.

Figure 5:
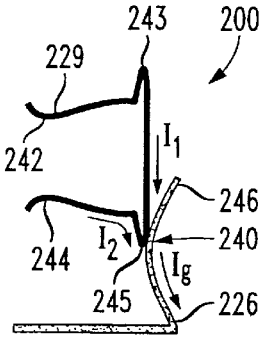
FIG. 5 is a left-side close-up view of a portion of a grounding device in accordance with another embodiment of the present invention.

Another preferred embodiment is shown as 200 in FIG. 5. In this embodiment, the design of clip 229 is slightly modified from the design of clip 129 in FIG. 4 in that the bent regions 243, 245 each form a single peak as opposed to the double peak design of FIG. 4. Nevertheless, the contact node 240 is positioned to ensure that the direction of current $I_2$ at node 240 is the same as current $I_1$.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is the intention, therefore, to be limited only as indicated by the scope of the claims appended hereto.

We claim:

1. A grounding device for providing a grounding path for a voltage surge and for maintaining the grounding path for subsequent voltage surges, comprising:

a mounting base having a terminal connectable to electronic common ground for establishing a grounding path;

a tip conductor terminal;

a ring conductor terminal;

an electronic module connected to said tip conductor terminal and said ring conductor terminal;

a current carrying member connected to said electronic module and having a first leg for defining a first current carrying path for carrying current over said first leg in a first direction along said grounding path, and a second leg for defining a second current carrying path for carrying current over said second leg in a second direction, said current being generated from a high voltage surge applied to said electronic module; and a voltage surge discharge member in contact with said current carrying member at a contact node and connected to said mounting base for directing voltage surges from said current carrying member to said base for transfer to the electronic common ground, said surge discharge member being positioned for contact with said current carrying member between said first and said second legs so that a repelling magnetic field produced by current flowing through said second current carrying path is reduced relative to a magnetic field produced by current flowing through said voltage surge discharge member.

2. The grounding device of claim 1, further comprising a tip current surge sensor connected between said tip conductor terminal and said mounting base for providing grounding of current surges between said tip terminal and said mounting base, and a ring current surge sensor connected between said ring conductor terminal and said mounting base for providing grounding of current surges between said ring terminal and said mounting base, said current surges being produced from overcurrent conditions.

3. The grounding device of claim 2, wherein said tip current sensor is moveably secured to and spaced from the grounding path by a meltable solder land.

4. The grounding device of claim 3, wherein said ring current sensor is moveably secured to and spaced from the grounding path by a meltable solder land.

5. The grounding device of claim 1, wherein said voltage discharge member comprises a leaf spring.

6. The grounding device of claim 1, wherein said current carrying member is configured as a substantially "C"-shaped clip having bent regions formed therein.

* * * * *